US007522989B2

(12) United States Patent
Matsuda

(10) Patent No.: US 7,522,989 B2
(45) Date of Patent: Apr. 21, 2009

(54) CARRIAGE SYSTEM

(75) Inventor: Hiroyuki Matsuda, Ichinomiya (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 418 days.

(21) Appl. No.: 11/368,684

(22) Filed: Mar. 7, 2006

(65) Prior Publication Data

US 2006/0253244 A1 Nov. 9, 2006

(30) Foreign Application Priority Data

May 6, 2005 (JP) ..... 2005-134874

(51) Int. Cl.
*G08G 1/00* (2006.01)

(52) U.S. Cl. ..... 701/117; 307/9.1

(58) Field of Classification Search ..... 701/1, 701/23–24, 300–302, 205, 207, 210, 214, 701/117; 307/9.1, 10.1
See application file for complete search history.

(56) References Cited

U.S. PATENT DOCUMENTS

| | | | | |
|---|---|---|---|---|
| 5,751,245 | A * | 5/1998 | Janky et al. | 342/357.07 |
| 6,845,316 | B2 * | 1/2005 | Yates | 701/117 |
| 6,904,359 | B2 * | 6/2005 | Jones | 701/204 |
| 2002/0186658 | A1 * | 12/2002 | Chiu et al. | 370/237 |

FOREIGN PATENT DOCUMENTS

| | | | |
|---|---|---|---|
| JP | 06-083445 | A | 3/1994 |
| JP | 06-208699 | A | 7/1994 |
| JP | 09-270093 | A | 10/1997 |
| JP | 10-21492 | | 1/1998 |
| JP | 10-021492 | A | 1/1998 |
| JP | 2002-96725 | | 4/2002 |
| JP | 2004-110288 | A | 4/2004 |
| JP | 2004-20735 | | 7/2004 |

OTHER PUBLICATIONS

Notification of Reason(s) for Refusal dated Nov. 18, 2008 issued in corresponding Application No. 2005-134874.

* cited by examiner

*Primary Examiner*—Dalena Tran
(74) *Attorney, Agent, or Firm*—Westerman, Hattori, Daniels & Adrian, LLP.

(57) ABSTRACT

The present invention provides a carriage system which, to choose one of a plurality of running routes, can appropriately determine the congestion statuses of the running routes to choose one of them along which a carriage can reach its destination earliest. In a carriage system 10, each carriage 1 is provided with running status reporting means 1*b* for reporting a running status based on a running speed to a zone controller 3. The zone controller 3 is provided with congestion information generating means 3*b* for generating congestion information by putting together reports from the running status reporting means 1*b* of the carriages 1.

4 Claims, 4 Drawing Sheets

CARRIAGE SYSTEM

FIELD OF THE INVENTION

The present invention relates to a carriage system for use in a clean room in a manufacture plant for semiconductors, liquid crystal display devices, or the like, the carriage system using automatically running carriages to convey processing targets (semiconductor wafers, glass substrates of liquid crystal display devices, or the like) among a large number of stations (where various processes or machining operations are performed on the process targets).

BACKGROUND OF THE INVENTION

With progresses in semiconductors and liquid crystal industries, more advanced and efficient carriage systems are requested which can convey processing targets more quickly to target stations.

The Japanese Patent No. 3508130 has been proposed which is intended to meet the above requirement.

In this carriage system, carriages can run between intrabays (in the Japanese Patent No. 3508130, running loops 20 to 25) and interbays (in the Japanese Patent No. 3508130, running loops 2 and 3) which are otherwise composed of closed conveying paths so that processing targets are transferred between the intrabays and interbays via transfer warehouses (in the Japanese Patent No. 3508130, stockers). This carriage system eliminates the need for the transfer of processing targets via the transfer warehouses to increase conveyance speed. The carriage system also enables a reduction in system costs by eliminating the need for the transfer warehouses.

However, in this carriage system, in which the large number of carriages run among the plurality of bays (loops), one of a plurality of running routes must be chosen. The congestion statuses of the running routes thus need to be appropriately determined to select one of them through which the carriage can reach the target station earliest. However, this carriage system does not take this into account.

The present invention solves the above problem. An object of the present invention is to provide a carriage system which, to choose one of a plurality of running routes, can appropriately determine the congestion statuses of the running routes to choose one of them along which a carriage can reach its destination earliest.

SUMMARY OF THE INVENTION

Claim 1 of the present invention sets forth a carriage system comprising a plurality of carriages and a controller controlling the carriages, wherein each carriage is provided with running status reporting means for reporting a running status based on a running speed to the controller, and the controller is provided with congestion information generating means for generating congestion information by putting together reports from the running status reporting means of the carriages.

In a carriage system set forth in claim 2 that is dependent on claim 1, the controller is provided with congestion information transmitting means for transmitting the congestion information generated to the carriages, and each carriage is provided with running route re-searching means for re-searching for a running route on the basis of the congestion information received from the congestion information transmitting means.

In a carriage system set forth in claim 3, depending on the congestion level in the congestion information, the running route re-searching means re-searches a running route at an earlier encountered branch point on the basis of the congestion information.

In a carriage system set forth in claim 4 that is dependent on claim 2, the running route re-searching means re-searches for a running route taking into account the weight of each route corresponding to the congestion level in the congestion information.

According to the carriage system set forth in claim 1, each carriage is provided with the running status reporting means, and the controller is provided with the congestion information generating means. This enables the congestion status of each conveyance path to be mechanically determined accurately and appropriately.

According to the carriage system set forth in claim 2, the controller is provided with the congestion information transmitting means, and each carriage is provided with the running route re-searching means. Thus, this carriage system not only produces the effect of claim 1 but also enables the carriage to run while avoiding congested routes. This enables the carriages to operate efficiently.

According to the carriage system set forth in claim 3 and 4, depending on the congestion level in the congestion information, the running route re-searching means re-searches a running route at an earlier encountered branch point on the basis of the congestion information, or the running route re-searching means re-searches for a running route taking into account the weight of each route corresponding to the congestion level in the congestion information. Thus, this carriage system not only produces the effect of claim 2 but also enables such an optimum running route to be mechanically automatically searched for.

DETAILED DESCRIPTION OF THE PREFERRED EMBODIMENTS

Embodiments of the present invention will be described below with reference to the drawings.

Embodiment 1

Figure 1:
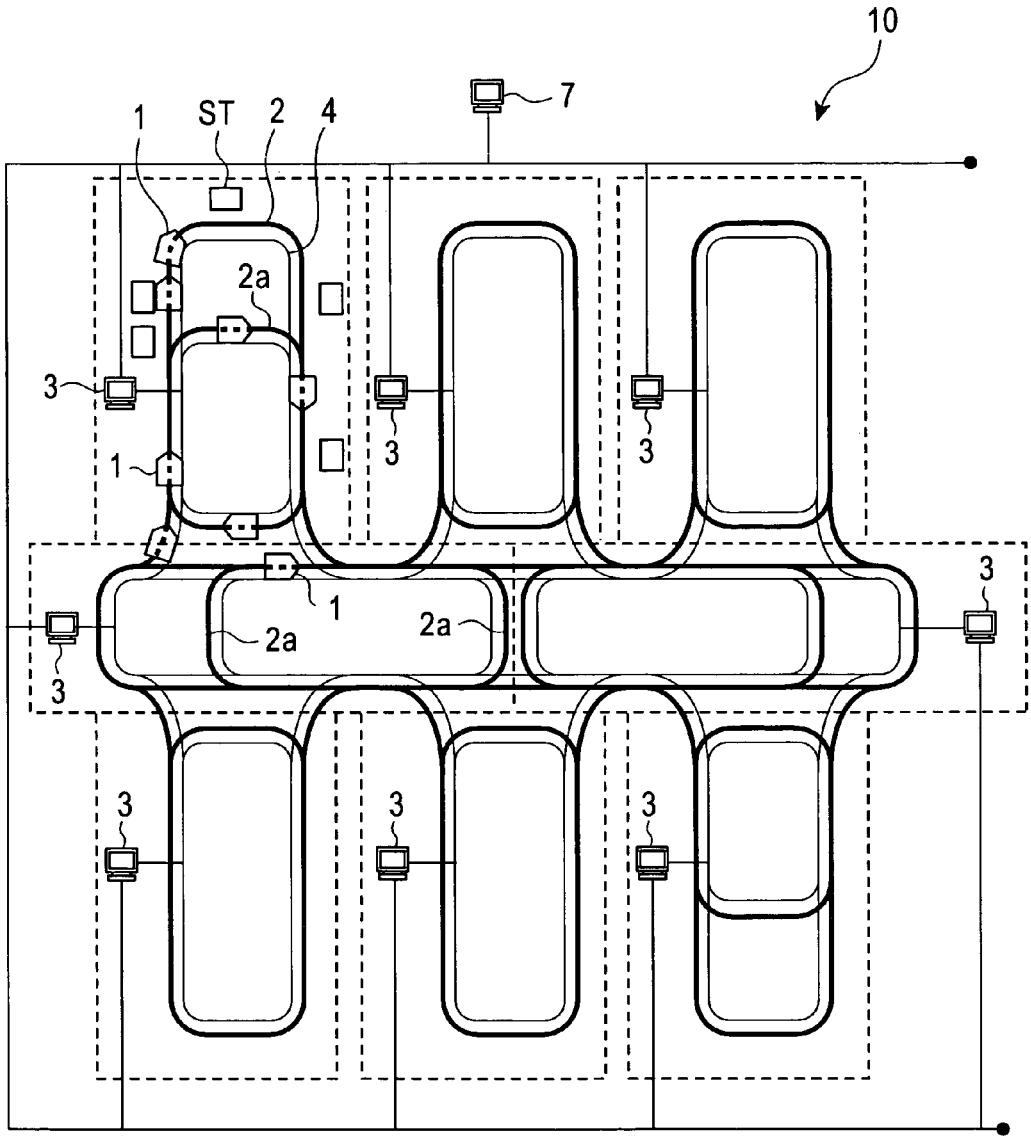
FIG. 1 is a diagram showing a general configuration of an example of a carriage system in accordance with the present invention.
Figure 2A:
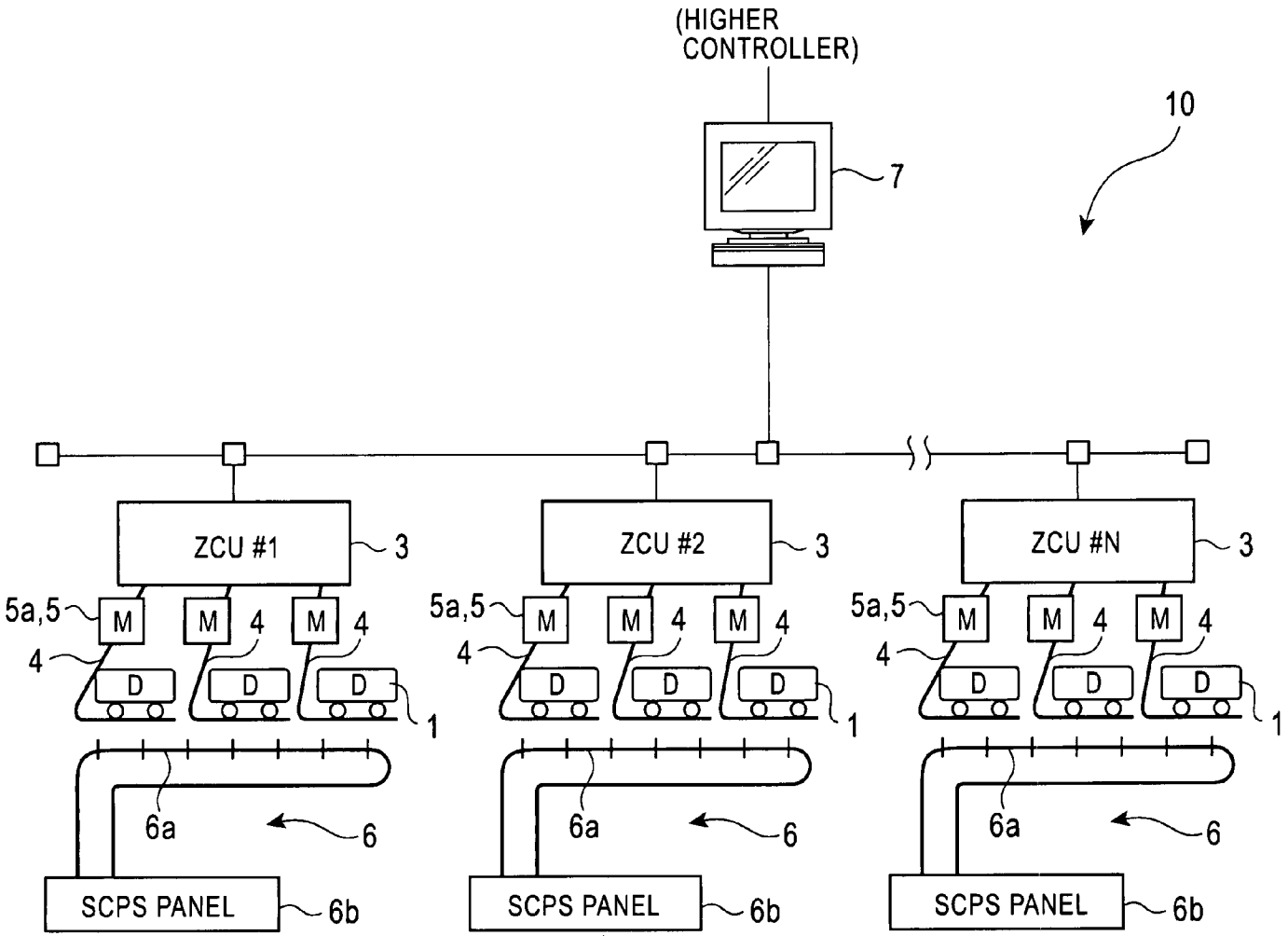
FIG. 2A is a diagram conceptually showing a control system in the carriage system shown in FIG. 1.
Figure 2B:
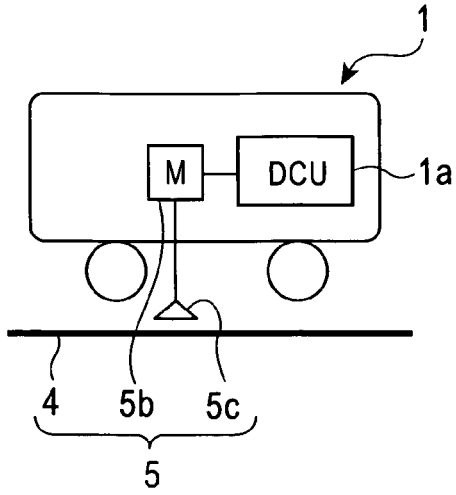
FIG. 2B is a detailed diagram showing an essential part of feeder radio means shown in FIG. 2A.
Figure 2C:
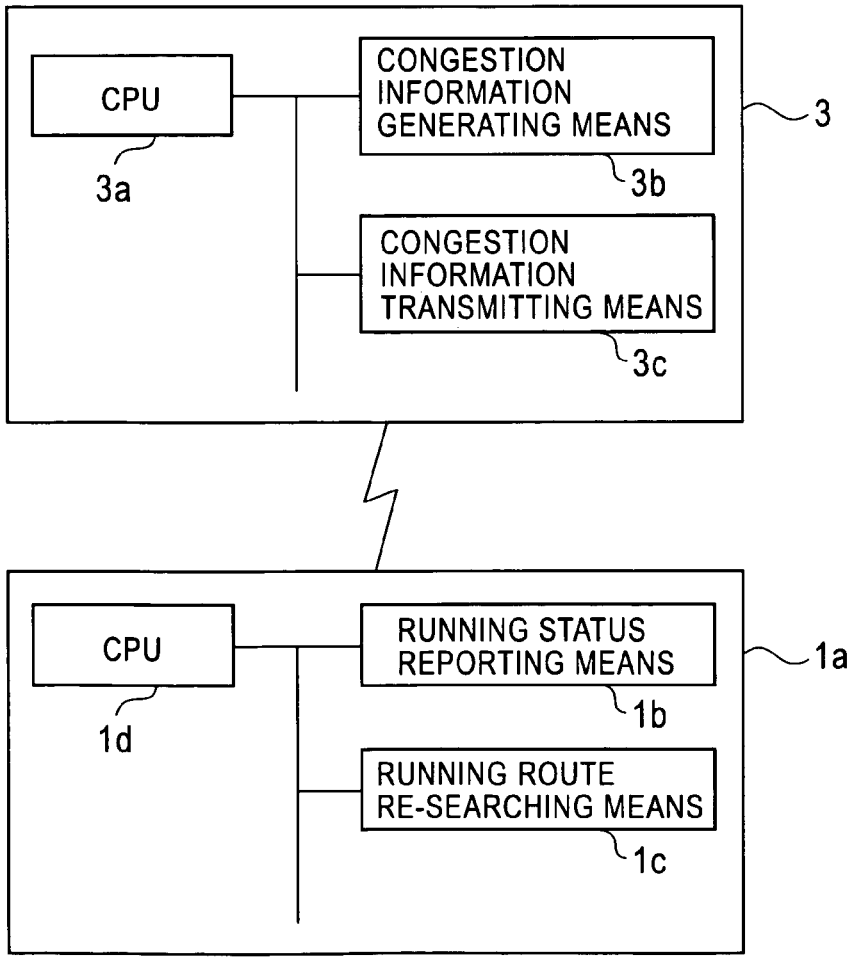
FIG. 2C is a detailed diagram showing essential parts of a carriage controller and a zone controller shown in FIG. 2A.

FIG. 1 is a diagram showing a general configuration of an example of a carriage system in accordance with the present invention. FIG. 2A is a diagram conceptually showing a control system in the carriage system shown in FIG. 1. FIG. 2B is a detailed diagram of an essential part of feeder radio means shown in FIG. 2A. FIG. 2C is a detailed diagram of essential parts of a carriage controller and a zone controller.

A carriage system 10 is used in a clean room in a manufacture plant for semiconductors, liquid crystal display devices, or the like. The carriage system 10 uses automatically running carriages to convey processing targets (semiconductor wafers, glass substrates of liquid crystal display devices, or the like) among a large number of stations (where various processes or machining operations are performed on the process targets).

The carriage system 10 comprises at least a large number of carriages 1 that transfer processing targets, a conveyance path 2 along which the carriages 1 move, zone controllers (ZCU) 3 each controlling a plurality of carriages 1 running along the conveyance path 2 within a given range (hereinafter referred to as a "zone" and enclosed by dot lines in FIG. 1), and a communication line 4 through which the zone controllers 3 communicate with the carriages 1 by radio.

The carriage system 10 further comprises feeder radio means 5 (see FIG. 2) each enabling the radio communication between the zone controller 3 and the plurality of carriages 1, non-contact power supply means 6 (see FIG. 2) supplying power to the running carriages 1, and an integral controller 7 controlling the plurality of zone controllers 3.

As mentioned above, the processing targets are semiconductor wafers or glass substrates of liquid crystal display devices. Actually, cassettes are conveyed each of which can accommodate a predetermined number of semiconductor wafers. Conveyance targets of the carriages 1 may thus be referred to as cassettes instead of the processing targets.

The carriages 1 are roughly classified into two types, a ground running type and an overhead running type. Here, the overhead running type will be described by way of example. The overhead running type avoids the presence of people near running routes and thus enables the carriages to run and convey targets at a higher speed.

In this example, the conveyance route 2 is installed on the ceiling and is configured so that the carriages 1 can run onto a smaller one of a plurality of loops (conveyance paths along which the carriages can circulate) via a larger one. Stations ST are installed at every desired point on the conveyance path 2 to execute various processes on the processing targets.

In FIG. 1, the number of carriages 1, the shape of the conveyance path 2, and the number of stations ST are shown limited by way of example. However, in fact, very large numbers of these components are complicatedly installed.

A large number of shortcuts 2*a* are provided on the conveyance path 2 so as to enable a running route to be chosen depending on the situation.

As shown in FIG. 1, the communication line 4 is provided completely along the conveyance path 2. The communication line 4 is located at a very short distance from the carriage 1 running along the conveyance path 2, to enable radio communications with the carriage 1 whether it is at a stop or is running.

A communication control system of the carriage system 10 will be described with reference to FIGS. 2A and 2B.

The carriage 1 includes a carriage controller (DCU) 1*a* including a central processing unit (CPU) 1*d* and which can independently perform various control operations and processes.

The feeder radio means 5 enables the communication between the carriage 1 and the zone controller 3. The feeder radio means 5 comprises the communication line 4 composed of parallel two feeder lines, a master modem (M) 5*a* that processes the communication between the zone controller 3 and the communication line 4, a slave modem (M) 5*b* that processes the communication between the carriage 1 and the communication line 4, and an antenna 5*c* installed in the carriage 1 at a given proximity distance to the communication line 4.

In a practical sense, a limited length of the communication line 4 used in the feeder radio means 5 is assigned to one channel. Although not shown in the drawings, mutually cut communication lines 4 each of a predetermined length are actually installed at given intervals so as to conform to the shape of the conveyance path 2.

One zone corresponds to a communication area covered by three of these communication lines 4 each of the predetermined length. One zone controller 3 can control these three communication lines 4 for the respective channels.

Although limited as described above, the proximity communication achieved by the feeder radio means 5 enables the communication lines 4 for the different channels to be installed along the conveyance path 2 in proximity to one another to the degree that communications are not interrupted. Further, communication via the communication line 4 for one channel does not interfere with the carriage 1 running along the communication line 4 for another channel. It is always possible to communicate only with the carriage 1 running on the communication line 4 for a particular channel. The feeder radio means 5 is thus suitable as communication means for the communication between the carriage 1 and zone controller 3 in the carriage system 10.

The communication means is not limited to the feeder radio means 5, and any communication means may be used provided that it has characteristics similar to those of the feeder radio means 5.

The non-contact power supply means 6 comprises a power supply line 6*a* for power supply, a control panel (SCPS panel) 6*b*, and a receiving coil (not shown in the drawings) provided in the carriage 1.

The power supply line 6*a* is installed completely along the conveyance path 2. An alternating current is passed through the power supply line 6*a* to supply power, by electromagnetic induction, to the receiving coil provided in the carriage 1 located in proximity to the power supply line 6*a* in a non-contact manner.

In contrast to conventional trolley reception, the non-contact power supply means 6 has no contact portion between the power supply line 6*a* and the carriage 1, thus avoiding contact-induced dust. The non-contact power supply means 6 is thus suitable for clean rooms.

However, each power supply line 6*a* has a limited length (in this example, 80 meters) and can supply power only to a limited number (in this example, 20 to 30) of carriages 1.

Accordingly, the carriage system 10 needs to be configured taking these limitations into account. That is, the zone controller 3 determines the particular power supply line 6*a* on which each carriage 1 is running. The zone controller 3 thus performs control such that the number of carriages 1 running on one power supply line 6*a* will not exceed the predetermined value.

For the power supply line 6*a*, lines each of a predetermined length are also installed along the conveyance path 2 so that a joint of a given length is present between two adjacent power supply lines. In these joints, the carriages 1 may not be able to receive power.

Thus, in the present carriage system 10, a lateral pair of power supply lines 6*a* is laid along the conveyance path 2. A lateral pair of receiving coils of the carriage 1 side is also correspondingly provided, and each of the joints in the right-hand power supply lines 6*a* is not located at the same position at which the corresponding joint in the left-hand power supply lines 6*a* is located. This prevents power supply from being interrupted.

The carriage 1 comprises running driving means in addition to the components shown in FIG. 2B. The running driving means saves map data (required to allow the carriage 1 to run automatically along the conveyance path 2) to a nonvolatile memory. Where the carriage 1 is instructed to convey a target from a station ST with a particular conveyance path 2 to another station ST, the running driving means can determine a running route to allow the carriage 1 to run along this route.

In this case, the carriage 1 runs while reading position markers provided on the conveyance path 2 to determine the particular zone and position in the entire conveyance path 2 in and at which the carriage 1 is running.

The carriage system thus executes distributed processing such that each carriage 1 is provided only with the start and end points of conveyance and performs, by itself, control such as the determination of a running route. This reduces burdens on the zone controller 3 and the like and improves the degree of freedom and flexibility of the present carriage system 10, in which each carriage 1 arbitrarily runs among the zones at its discretion.

A noticeable feature of the carriage system 10 having the above characteristics is its function of making determinations about congestion, which has not been proposed yet.

To enable this congestion determination, arrangements shown in FIG. 2C are provided as follows. The carriage controller 1*a* of each carriage 1 is provided with running status reporting means 1*b* for reporting a running status based on a running speed to the zone controller 3. The zone controller 3 is provided with congestion information generating means 3*b* for generating congestion information by putting together reports from the running status reporting means 1*b* of the carriages 1.

The zone controller 3 is also provided with congestion information transmitting means 3*c* for transmitting congestion information generated to each carriage 1. Each carriage 1 is provided with running route re-searching means 1*c* for re-searching for a running route on the basis of congestion information received from the congestion information transmitting means 3*c*.

In the carriage controller 1*a* in FIG. 2C, the running status reporting means 1*b* and the running route re-searching means 1*c* are shown as hardware components separate from the central processing unit 1*d*. In the zone controller 3, the congestion information generating means 3*b* and the congestion information transmitting means 3*c* are shown as hardware components separate from the central processing unit 3*a*. However, actually, the functions of the means 1*b*, 1*c*, 3*b*, 3*c* are generally executed by holding programs providing the functions of the means 1*b*, 1*c*, 3*b*, 3*c* in the carriage controller 1*a* and zone controller 3*a* and allowing the central processing units 1*d*, 3*a* to execute the programs.

Figure 3:
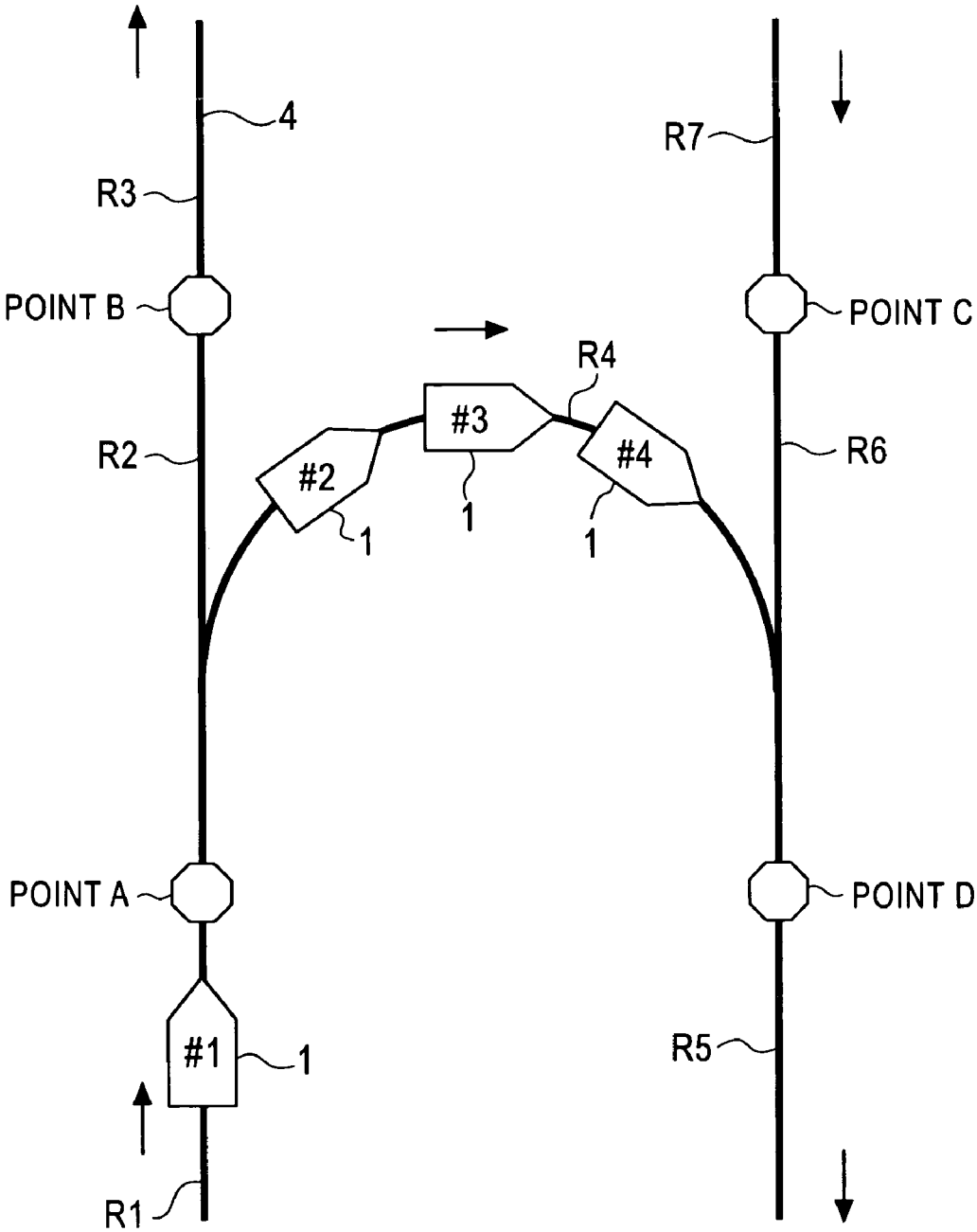
FIG. 3 is a diagram conceptually illustrating a congestion determination that is characteristic of the carriage system shown in FIG. 1.

FIG. 3 is a diagram conceptually illustrating the congestion determination, which is characteristic of this carriage system. With reference to FIG. 3, a description will be given of how the congestion determination can be made using the running status reporting means 1*b* and running route re-searching means 1*c*, provided in the carriage 1, and the congestion information generating means 3*b* and congestion information transmitting means 3*c*, provided in the zone controller 3.

FIG. 3 is an enlarged diagram of a part of the conveyance path 2 shown in FIG. 1. A semicircular conveyance path 4 joins two linear conveyance paths 4 together.

The carriage 1 (#1) is running on the left-hand conveyance path 4 toward the upper end of the drawing and has not reached a branch point to the semicircular conveyance path 4 yet. The three carriage 1 (#2), carriages 1 (#3), and carriages 1 (#4) are running on the semicircular conveyance path 4 toward the right end of the drawing and have not reached a juncture to the linear conveyance path 4 yet.

Points A, B, C, D are set so as to sandwich the branch point and juncture between them; the branch point and the juncture are located between the lateral linear conveyance paths 4 and the semicircular conveyance path 4. The carriage 1 (#1) has not passed through the point A yet.

Sections partitioned by the points A, B, C, D are named routes R1 to R7 as shown in the figure.

The route R4 corresponding to the semicircular conveyance path 4 is a shortcut along which the carriage 1 (#1) can reach the point D earlier than if it passes through the routes R2, R3, non-illustrated routes, and the route R7 and route R6 before reaching the point D.

The running status reporting means 1*b*, provided in each carriage 1, has data (a part of the map data) on a standard speed specified for the route along which the carriage 1 is running. The running status reporting means 1*b* determines the actual running speed and obtains data indicating that the running status is good, average, or bad, on the basis of the percentage of the standard speed for which the actual running speed accounts. The running status reporting means 1*b* then sends the data to the zone controller 3.

Specifically, for example, the carriage 1 (#1) sends a running status indicating that the "route R1 is good", to the zone controller 3. The carriage 1 (#2), carriage 1 (#3), and carriage 1 (#4) send a running status indicating that the "route R4 is bad", to the zone controller 3.

The carriage 1 can read the position markers installed along the conveyance path 4 to determine, by itself, its own position (route) on the map data held by itself and the actual running speed. The carriage 1 can also determine, by itself, the distances to the preceding and succeeding carriages 1 and thus the running speed.

When the zone controller 3 receives the running status of each route from the running status reporting means 1*b* of each carriage 1, the congestion information generating means 3*b* generates the level of congestion, congestion information on the route, on the basis of the number of statuses indicating that the route is good, average, or bad, that is, the number of carriages 1 having reported that running status.

For example, the level of congestion is generated on the basis of the following criteria.

A high congestion level: at least three carriages report that the route is bad. An average congestion level: at most two carriages report that the route is bad and at most three carriages report that the route is average. A low congestion level: no carriages report that the route is bad and at most two carriages report that the route is average. A zero congestion level: no carriages report that the route is bad and no carriages report that the route is average. A ∞ (infinite) congestion level: the route is closed.

The criteria for the determination and generation of the congestion level are only illustrative. The determination may be based on the duration of the high congestion level. Basically, the congestion level is empirically determined through trials and errors. The information on the ∞ (infinite) congestion level is not provided by the carriages 1 but by a higher controller to the zone controller 3 via the integral controller 7.

Once the congestion information generating means 3*b* generates the congestion level of each route, the zone controller 3 broadcasts the congestion information to the other zone controllers 3. Upon receiving the congestion information, each zone controller 3 uses the congestion information transmitting means 3*c* to broadcast the congestion information to all the carriages 1 present within its own zone (in this case, the broadcasting is also called crosstalk).

Upon receiving real-time congestion information containing the congestion level of each route from the zone controller 3, each carriage 1 uses the running route re-searching means 1*c* to re-search for running routes to its destination taking the congestion information into account. The carriage 1 thus chooses a running route along which it can reach the destination earliest and then continues running.

A specific description will be given with reference to FIG. 3. It is assumed that the three carriages 1 (#2) to (#4) on the route R6 have reported that the route R4 is bad. Then, the congestion information generating means 3*b* of the zone controller 3 determines that the congestion level of the route R5 is high. This information is then distributed to the carriage 1 (#1).

When the carriage 1 (#1) receives the information, its running route re-searching means 1*c* determines that a longer time is required to pass through the route R4, which is otherwise a shortcut. The carriage 1 (#1) then chooses any of the routes R2, R3, . . . . This enables the carriage 1 (#1) to avoid the congestion on the route R4 to reach the point D earlier.

If the congestion information held in the carriage 1 is not updated for a given time (30 to 60 minutes), it is considered to be canceled. The reason is as follows. The congestion status varies moment by moment. If congestion information is not distributed because the certainty of communications is less than 100%, when the carriage 1 holds outdated congestion information, it may mistakenly determine that the congestion status has been improved and thus choose a time-consuming route.

On the other hand, when the carriage 1 starts to run, the carriage 1 receives congestion information from the zone controller 3 and holds it. Further, the congestion information containing the ∞ (infinite) congestion level indicates that the situation cannot be improved and may thus be held until the information containing the zero congestion level is received.

Specifically, the running route re-searching means 1*c* makes determinations as described below. This enables self-determinations based on computer processing.

1) Depending on the congestion level in the congestion information, the carriage re-searches for a running route at an earlier encountered branch on the basis of the congestion information.

For example, for the high congestion level, the carriage re-searches for routes that do not involve the route of the high congestion level. That is, the carriage selects, at the first branch point, a running route that detours the congested route.

For the average congestion level, the carriage runs to a point midway between the start point and the destination, and at a subsequently encountered branch point, selects a running route that detours the congested route.

For the low congestion level, the carriage selects a running route that detours the congested route, at the final branch point immediately before arrival at the destination.

2) The carriage 1 re-searches for a running route taking into account the weight of each route corresponding to the congestion level in the congestion information.

This method takes into account the length of each route, the standard speed, and the congestion level to determine the time required for each route, that is, the weight of each route, to choose a running route with the smallest weight value.

Thus, in the carriage system 10, each carriage 1 is provided with the running status reporting means 1*b*, and the zone controller 3 is provided with the congestion information generating means 3*b*. The congestion status of the conveyance path 2 can be mechanically determined both accurately and appropriately.

Further, the controller 3 is provided with the congestion information transmitting means 3*c*, and each carriage 1 is provided with the running route re-searching means 1*c*. This enables the carriage 1 to run while avoiding congested routes. The carriage 1 can thus be efficiently operated.

Depending on the congestion level in the congestion information, the running route re-searching means 1*c* re-searches a running route at an earlier encountered branch point on the basis of the congestion information, or the running route re-searching means 1*c* re-searches for a running route taking into account the weight of each route corresponding to the congestion level in the congestion information. Such an optimum running route can thus be mechanically automatically searched for.

The reason for the use of a technique based on such distributed processing is as follows. If, for example, the zone controller 3 executes all the relevant processes, what is called a supercomputer is required to control a large number of carriages 1, which run fast and independently and which move into and out of the zones. However, the above method enables what is called a personal computer or the like to control these carriages 1.

The congestion information generating means and the congestion information transmitting means may be provided in the integral controller 7 instead of the zone controller 3. In this case, running status reports from the carriages 1 are sent to the integral controller 7 via the zone controller 3, which generates and transmits congestion information.

The above specific configuration is not limited to the one described in the specification but includes equivalents or alternatives easily conceivable by those skilled in the art.

The carriage system in accordance with the present invention can be used in all the industries in which the system is used in a clean room in a manufacture plant for semiconductors, liquid crystal display devices, or the like and in which the system needs to efficiently perform an operation of automatically conveying processing targets among a large number of stations.

The invention claimed is:

1. A carriage system comprising:

a plurality of carriages;

a conveyance path along which the plurality of carriages move, the conveyance path including a plurality of running routes for the carriages; and a controller controlling the carriages, wherein each carriage is provided with running status reporting means for evaluating its running status as the carriage travels along a particular route and reporting the running status to the controller, the running status being evaluated based on the carriage running speed along the particular route as a percentage of a standard speed specified for the particular route, and the controller is provided with congestion information generating means for generating congestion information by putting together reports from the running status reporting means of the carriages.

2. A carriage system according to claim 1, wherein the controller is provided with congestion information transmitting means for transmitting the congestion information generated to the carriages, and each carriage is provided with running route re-searching means for re-searching for a running route on the basis of the congestion information received from the congestion information transmitting means.

3. A carriage system according to claim 2, wherein depending on the congestion level in the congestion information, the running route re-searching means re-searches a running route at an earlier encountered branch point on the basis of the congestion information.

4. A carriage system according to claim 2, wherein the running route re-searching means re-searches for a running route taking into account the weight of each route corresponding to the congestion level in the congestion information.

* * * * *